United States Patent [19]

Böhler et al.

[11] 4,296,517

[45] Oct. 27, 1981

[54] PORTABLE SPINNERET CLEANER

[75] Inventors: Joachim Böhler, Grosswallstadt; Hans Jordon, Rudenau, both of Fed. Rep. of Germany

[73] Assignee: Akzona Incorporated, Asheville, N.C.

[21] Appl. No.: 85,839

[22] Filed: Oct. 17, 1979

[30] Foreign Application Priority Data

Oct. 27, 1978 [DE] Fed. Rep. of Germany ... 7832006[U]

[51] Int. Cl.[3] ..... B08B 13/00

[52] U.S. Cl. ..... 15/93 R; 15/3; 15/236 B; 264/169; 425/225

[58] Field of Search ..... 15/1, 3, 93 R, 236 R, 15/236 B; 425/225, 232; 264/169

[56] References Cited

U.S. PATENT DOCUMENTS

| | | | |
|---|---|---|---|
| 2,664,586 | 1/1954 | Prins et al. | 15/93 R |
| 3,804,569 | 4/1974 | Walker | 425/225 |
| 3,975,475 | 8/1976 | Foley | 425/225 X |

*Primary Examiner*—Edward L. Roberts

*Attorney, Agent, or Firm*—Francis W. Young; Tom R. Vestal

[57] ABSTRACT

A portable spinneret cleaner consisting of a base plate, a cylindrical case attached thereto and having a flat stop surface at its end, and at least two guide bars pivoted therein and being fitted at one end with holders for at least one knife blade each, the cutting edge of which is capable of being moved into the stop surface plane against a spring action.

3 Claims, 7 Drawing Figures

PORTABLE SPINNERET CLEANER

Spinnerets, especially those used in melt-spinning, must generally be cleaned on spinning-in and subsequently in cycles, as well as in the event of unexpected malfunctions resulting from deposits of oligomers, thermally degraded melt, etc. In most cases, the cleaning must be performed without interrupting the melt flow through the spinneret and without removing the spinneret from the spinning machine specifically for this purpose.

Commonly and widely used for this purpose are manual spatulas, as described in U.S. Pat. No. 3,341,934. Since the contact pressure and the displacement of the spatula on the spinneret face during cleaning of the latter depend very much upon the service operator, the spinneret may easily be damaged. Furthermore, the duration and success of the cleaning procedure are determined by both skill and know-how of the service operators.

U.S. Pat. No. 3,804,569 describes a device whereby a spatula is mounted on a bracket pivoting on a shaft. However, with this device the spatula can only be operated after the shaft of the device has been screwed into a tap provided for this purpose in the spinneret. Here, as well, it is not possible to set a precise contact pressure between spatula and spinneret.

The subject matter of the innovation is to provide a portable spinneret cleaning unit which permits a speedier and simpler cleaning of spinnerets as heretofore possible, especially of spinnerets used in melt spinning, combined with great gentleness in treating the spinneret face and spinning orifices. Moreover, unskilled personnel should also be able to perform a reliable, uniform cleaning of the spinnerets in a short time.

The purposes herein are met according to the invention with a portable spinneret cleaning unit by means of a base plate provided with a handle, with mounted thereon an essentially cylindrical housing with a plane striker face at its free end, said housing having at least two guide bars pivotable on their axis, whose free ends have mountings for at least one blade, the cutting edge of which is aligned parallel to the striker face plane and protrudes slightly from the housing, but which can be moved against the tension of springs in the plane of the striker face.

In practice the unit is held with the cutting edge(s) gently against the spinning plate of the spinneret to be cleaned and the housing is moved over the spinneret until the plane striker face is in contact with the spinning plate. As a result of the spring tension counteracting this motion, the cutting edges of the blades (which are made of a softer material than the spinning plate) are in contact under a specific pressure with the spinning plate. Then the guide bars, either by hand or by motor, are made to turn synchronously to and fro, causing the knives to travel along the spinning plate and clean said plate.

A preferred version of the spinneret cleaning device of the invention has two diametrically aligned guide bars with mountings into which the sides of a single, semi-circular convex knife blade are inserted. A spring steel foil is thereby used as blade. By turning at least one of the guide bars, the previously semi-circular convex blade is deformed into a series of curves with at least one point of contraflexure, and the cutting edge of the blade thereby covers a circular area. At the end point the blade has resumed its semi-circular, convex shape.

Another preferred version is provided at the three joints of an equilateral triangle with guide bars with mountings—which bars can be made to pivot back and forth synchronously, e.g., by gear wheels—in which mountings a blade is inserted. As the guide bars are made to revolve back and forth, the blades cover an essentially hexagonal area of the spinneret face.

It is also possible to use more than three blades, however, the additional expense resulting from the more complex apparatus does not bring any substantial improvement in cleaning effect.

The innovation is explained in detail on hand of enclosed drawing wherein:

DETAILED DESCRIPTION OF THE DRAWINGS

Figure 1:
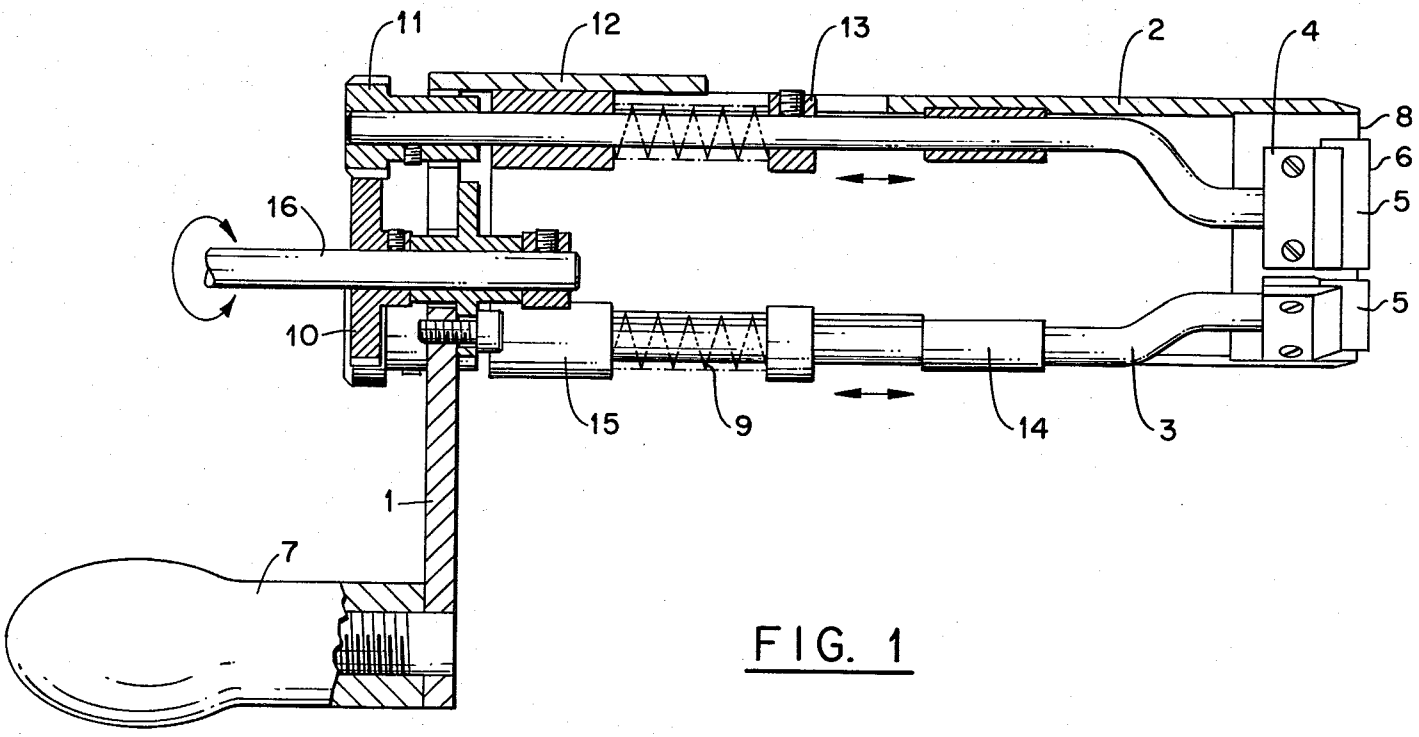
FIG. 1 is a section through a preferred version of the cleaning unit of the innovation with three synchronously rotatable guide bars and as many blades.

As shown in FIG. 1, the spinneret cleaning unit according to the innovation consists essentially of the following elements: base plate 1 with handle 7 at an angle holding plate 12, on which is mounted the essentially cylindrical housing 2, the free end of which, i.e., the end facing away from base plate 1 is provided with a level striker face 8, and three guide bars 3, pivotable on their axis, with at their tips mountings 4 to hold one, each, replaceable knife blade 5. The cutting edges 6 of blades 5 are aligned parallel to the plane of striker face 8 and protrude slightly from housing 2. When the unit is applied with cutting edges 6 on the spinning plate of a spinneret and is moved far enough over the spinneret for striker face 8 of housing 2 to make contact with the spinning plate, blades 5, mountings 4 and guide bars 3 move against the tension of springs 9 towards base plate 1. The spring tension is adjustable by means of adjusting rings 13 and determines the contact pressure between cutting edges and spinning plate. The guide bars 3 are located in bearings 14, 15 mounted on housing 2. At their lower end, here located below base plate 1, they have gear wheels 11, which can be synchronously driven by gear wheel 10 located on shaft 16 revolving to and fro.

The housing may assume any optional cross section, which as a rule, especially from the standpoint of dimensions, conforms to the shape of the spinnerets to be cleaned. Cylindrical housings of circular cross section will often be found appropriate. The housing need not have solid walls, but may be provided with recesses, openings, etc. to keep the weight of the portable unit low. A decisive feature is that the striker face 8 be large enough to allow stable positioning of the unit.

Shaft 16 may be rotated to and fro either by motor or, by means of a handle or the like, manually.

Figure 3:
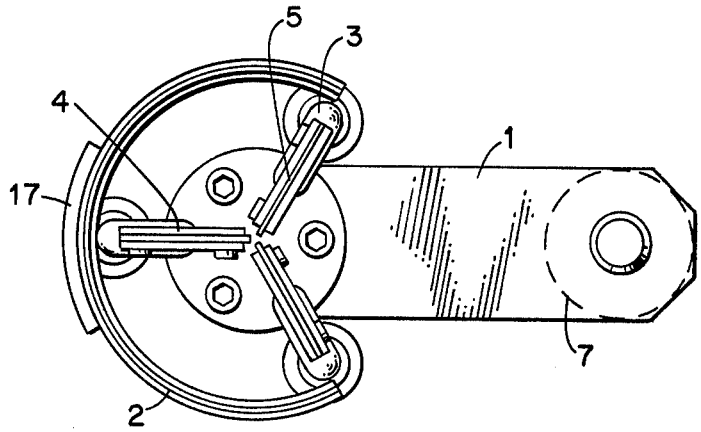
FIG. 3 is a plane view of the cleaning unit according to FIG. 1.
Figure 5:
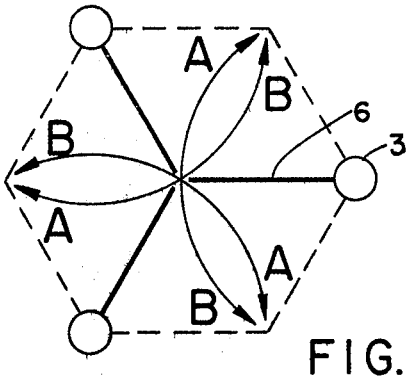
FIG. 5 is a schematic drawing of the motion of the blade cutting edges of the cleaning unit according to FIG. 1.

A plane view of the unit is shown in FIG. 3. The motion of the cutting edges 6 of blades 5 is drawn schematically in FIG. 5. All three cutting edges 6 move in the direction of arrows "A" or in the direction of arrows "B" thereby covering a hexagonal area.

Figure 2:
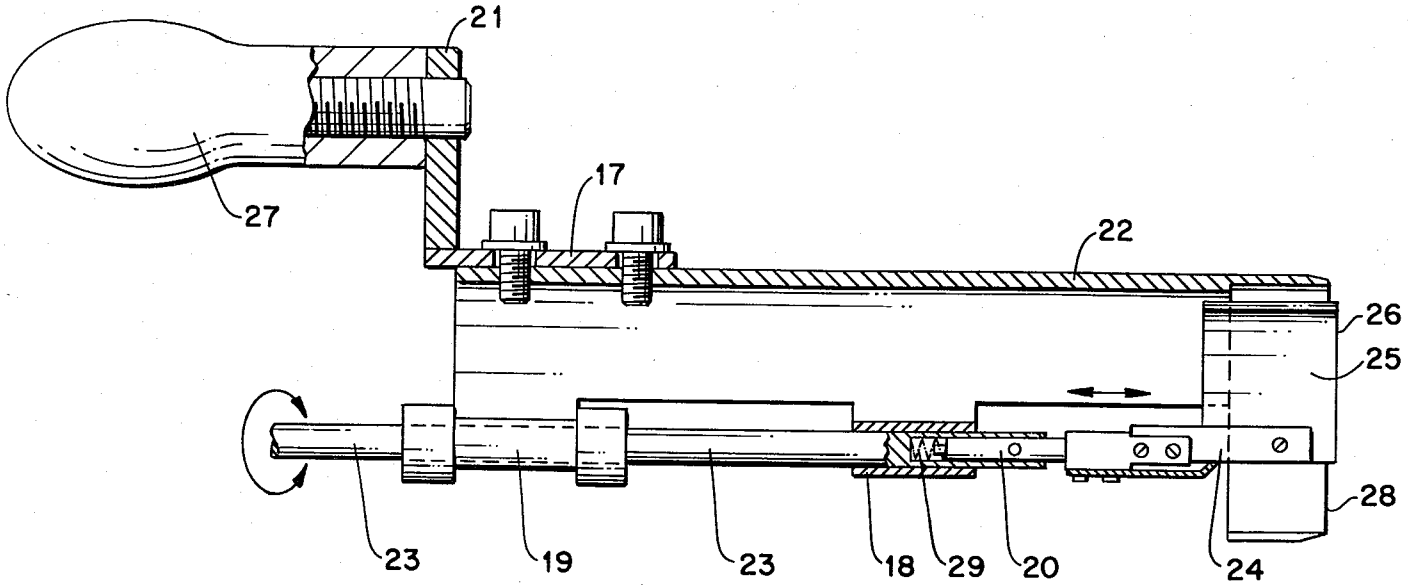
FIG. 2 is a section through another preferred version with two guide bars and a single blade.

Another version of the spinneret cleaning unit of the innovation is illustrated in FIG. 2. Base plate 21 with handle 27 has mounted at an angle holding plate 17 to which cylindrical housing 22 is fastened. Two diametrically (opposite) aligned guide bars 23 are located in bearings 18 and 19 mounted on housing 22. The upper ends of guide bars 23 are provided with bores. In these bores are located spiral springs 29 and guide pins 20 for mountings 24. A knife blade 25 is clamped on both sides in mountings 24 in such a manner that the cutting edge 26 is aligned parallel to striker face 28 of housing 22 and protrudes slightly from housing 22.

Figure 4:
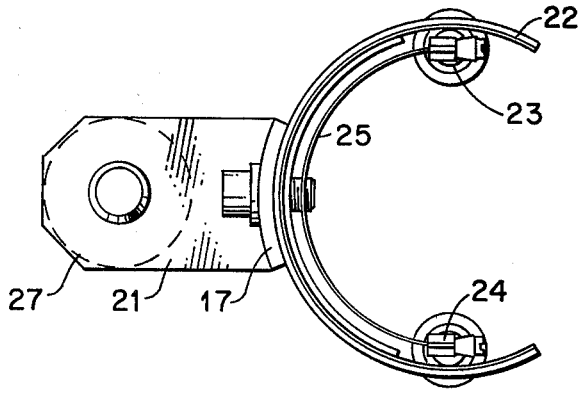
FIG. 4 is a plane view of the cleaning unit according to FIG. 2.
Figure 6:
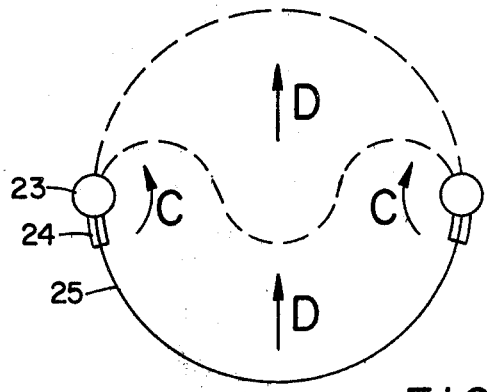
FIG. 6 is a schematic drawing of the motion of the blade cutting edge of the cleaning unit according to FIG. 2, with simultaneously counter-rotating motion of the guide bars.

A plane view of the unit is shown in FIG. 4. As can be clearly seen, blade 25 is inserted in a semi-circular, convex shape. When, as shown schematically in FIG. 6, both guide bars 23 are rotated in the direction of arrows "C" (i.e. counter-rotatingly), blade 25 moves in a series of curves with two points of contraflexure between the diametrical guide bars in the direction of arrows "D" into the once again semi-circular end position, indicated by a broken line.

Figure 7:
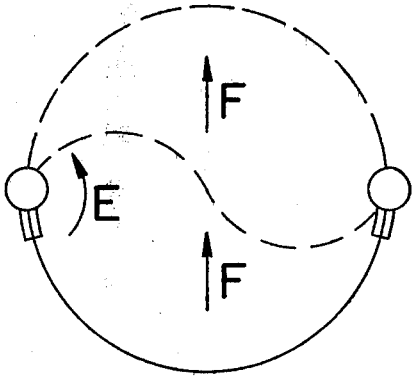
FIG. 7 is a similar illustration showing the rotation of only one guide bar.

If only one guide bar is rotated in the direction of arrow "E", the blade moves in a series of curves with one end point in the direction of arrow "F" to the semi-circular end position, indicated by a broken line (FIG. 7).

We claim:

1. A portable spinneret cleaning unit, comprising: a base plate; an essentially cylindrical housing mounted on said base plate, said housing having a plane striker face at its free end; at least two guide bars, and means for mounting said guide bars on said housing whereby said guide bars pivot about and move linearly along their axis; mountings on the free end of said guide bars to receive at least one blade, the cutting edge of said blade being aligned parallel with the free end of said housing; spring means mounted on said housing for yieldably urging said blade slightly above said striker face; and means for rotating at least one guide bar.

2. The portable spinneret cleaning unit of claim 1, wherein two said guide bars (23) are diametrically aligned and said mountings (24) have a single, semi-circular, convex blade (25) clamped into the side thereof.

3. The portable spinneret cleaning unit according to claim 4 wherein three of said guide bars are equiangularly aligned on said housing and wherein said means for rotating at least (1) guide bar comprises: a gear wheel axially mounted on said guide bar and handle means pivotably mounted on said base plate, one section of said handle means having a tooth section complimentary to said gear wheel whereby rotation of handle means produces rotation of said guide bar.

* * * * *